US005895623A

United States Patent [19]

Trokhan et al.

[11] Patent Number: 5,895,623

[45] Date of Patent: Apr. 20, 1999

[54] METHOD OF PRODUCING APERTURED FABRIC USING FLUID STREAMS

[75] Inventors: Paul Dennis Trokhan, Hamilton; Donald Carroll Roe, West Chester; Terrill Alan Young, Cincinnati, all of Ohio

[73] Assignee: The Procter & Gamble Company, Cincinnati, Ohio

[21] Appl. No.: 08/689,800

[22] Filed: Aug. 14, 1996

Related U.S. Application Data

[63] Continuation-in-part of application No. 08/333,269, Nov. 2, 1994, abandoned.

[51] Int. Cl.[6] ..... B32B 3/24; G03C 5/58; D04H 1/46

[52] U.S. Cl. ..... 264/504; 428/131; 428/137; 428/134; 428/156; 28/104; 28/105; 28/106; 430/320; 430/322; 442/408

[58] Field of Search ..... 428/131, 137, 428/134, 156; 28/104, 105, 106; 430/320, 322; 442/408; 264/504

[56] References Cited

U.S. PATENT DOCUMENTS

| | | | |
|---|---|---|---|
| 2,862,251 | 12/1958 | Kalwaites | 19/161 |
| 3,025,585 | 3/1962 | Griswold | 28/1 |
| 3,034,180 | 5/1962 | Greiner et al. | 19/155 |
| 3,081,512 | 3/1963 | Griswold | 28/72 |
| 3,322,617 | 5/1967 | Osborne | 162/296 |
| 3,485,706 | 12/1969 | Evans | 161/72 |
| 3,549,742 | 12/1970 | Benz | 264/250 |
| 3,682,756 | 8/1972 | Kalwaites | 161/109 |
| 3,768,121 | 10/1973 | Kalwaites | 19/161 P |
| 3,800,364 | 4/1974 | Kalwaites | 28/104 |
| 4,276,338 | 6/1981 | Ludwa et al. | 428/137 |
| 4,297,404 | 10/1981 | Nguyen | 428/85 |
| 4,379,799 | 4/1983 | Holmes et al. | 428/131 |
| 4,436,780 | 3/1984 | Hotchkiss et al. | 428/198 |
| 4,441,952 | 4/1984 | Mullane, Jr. | 156/222 |
| 4,514,345 | 4/1985 | Johnson et al. | 264/22 |
| 4,528,239 | 7/1985 | Trokhan | 428/247 |
| 4,529,480 | 7/1985 | Trokhan | 162/109 |
| 4,542,060 | 9/1985 | Yoshida et al. | 428/287 |
| 4,548,628 | 10/1985 | Miyake et al. | 55/487 |
| 4,637,859 | 1/1987 | Trokhan | 162/109 |
| 4,681,801 | 7/1987 | Eian et al. | 428/283 |
| 4,704,112 | 11/1987 | Suzuki et al. | 604/378 |
| 4,718,152 | 1/1988 | Suzuki et al. | 28/104 |
| 4,772,444 | 9/1988 | Curro et al. | 264/557 |
| 4,839,216 | 6/1989 | Curro et al. | 428/134 |

(List continued on next page.)

FOREIGN PATENT DOCUMENTS

| | | | |
|---|---|---|---|
| 0 215 684 A2 | 9/1986 | European Pat. Off. | D04H 1/44 |
| 0 223 614 A2 | 11/1986 | European Pat. Off. | D04H 1/44 |
| 0 333 211 A2 | 3/1989 | European Pat. Off. | D04H 1/44 |
| 0 418 493 A1 | 3/1991 | European Pat. Off. | D04H 1/44 |
| 0 750 063 A1 | 12/1996 | European Pat. Off. . | |
| WO 96/14457 | 5/1996 | WIPO | D04H 1/46 |

OTHER PUBLICATIONS

White, "Transporation Systems: Market For New Generation Composite Nonwovens?, " *Nonwovens Industry*, pp. 52–56 (Aug., 1996).

*Primary Examiner*—William P. Watkins, III

*Attorney, Agent, or Firm*—Marshall, O'Toole, Gerstein, Murray & Borun

[57] ABSTRACT

A method of forming apertured webs is provided comprising the steps of: (a) forming a foraminous member comprising gross foramina and fine foramina wherein the gross foramina define a patterned design superimposed on the fine foramina by means of applying and curing a photosensitive resin onto a foraminous element comprising fine foramina in order to form elevated portions on the fine foramina defining the gross foramina, (b) providing a layer of fibers on said foraminous member; and (c) applying fluid streams to said layer of fibers such that the fibers are randomly entangled in regions interconnected by fibers extending between adjacent entangled regions in a pattern determined by the pattern of the gross foramina of the foraminous member to form an apertured web.

3 Claims, 4 Drawing Sheets

U.S. PATENT DOCUMENTS

| | | | |
|---|---|---|---|
| 4,840,829 | 6/1989 | Suzuki et al. | 428/131 |
| 4,950,531 | 8/1990 | Radwanski et al. | 428/284 |
| 5,037,409 | 8/1991 | Chen et al. | 604/358 |
| 5,098,522 | 3/1992 | Smurkoski et al. | 162/358 |
| 5,098,764 | 3/1992 | Drelich et al. | 428/131 |
| 5,115,544 | 5/1992 | Widen | 28/105 |
| 5,204,158 | 4/1993 | Phillips et al. | 428/134 |
| 5,244,711 | 9/1993 | Drelich et al. | 428/113 |
| 5,245,025 | 9/1993 | Trokhan et al. | 536/56 |
| 5,277,761 | 1/1994 | Van Phan et al. | 162/109 |
| 5,334,289 | 8/1994 | Trokhan et al. | 162/358.2 |
| 5,342,338 | 8/1994 | Roe | 604/383 |
| 5,585,017 | 12/1996 | James et al. | 219/121.71 |
| 5,648,083 | 7/1997 | Blieszner et al. | 424/402 |
| 5,674,587 | 10/1997 | James et al. | 428/131 |
| 5,674,591 | 10/1997 | James et al. | 428/156 |

FIG. 1A
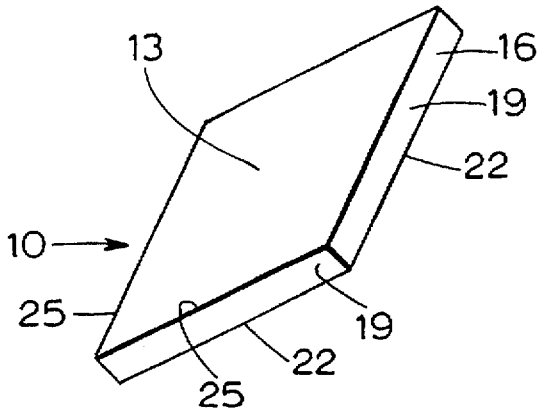
FIG. 1B
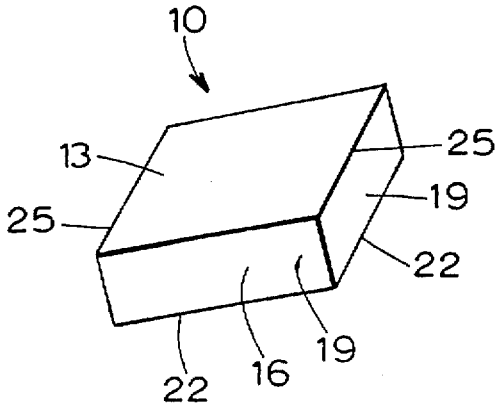
FIG. 1C
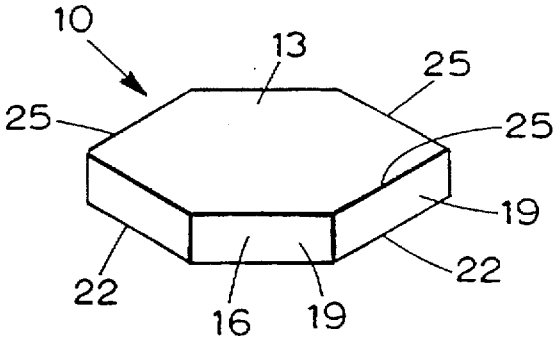
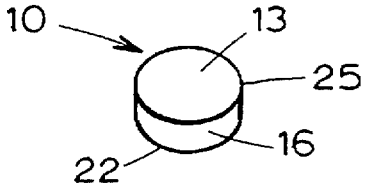
FIG. 1E
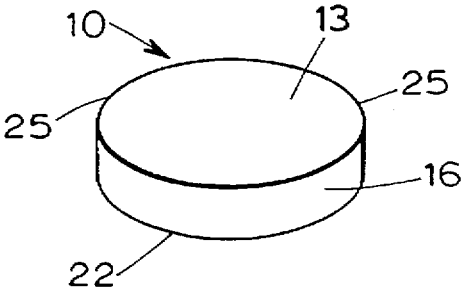
FIG. 1D

METHOD OF PRODUCING APERTURED FABRIC USING FLUID STREAMS

This is a Continuation-In-Part of application Ser. No. 08/333,269 filed on Nov. 2, 1994 abandoned.

BACKGROUND OF THE INVENTION

The present invention relates to methods of producing nonwoven fabrics generally, and more specifically to improved methods of producing apertured webs having a patterned design by means of a hydroentanglement process.

A variety of methods for producing apertured webs are known in the art. According to some methods air or liquid streams are employed to deposit fibers on a web surrounding solid protuberances which are used create apertures in the fibrous web. Kalwaites, U.S. Pat. No. 2,862,251 relates to hydroentanglement methods for production of nonwoven products wherein the application of fluid forces rearranges a layer of fibrous material, such as a web of fibers into a foraminous unitary nonwoven fabric structure comprising spaced, interconnected packed fibrous portions of the starting material, and openings arranged in a predetermined pattern which are separated by the interconnected packed portions. Specifically, a layer of fibrous material such rayon or cotton fibers is positioned between rigid means defining spaced apertures arranged in a pattern such as an apertured plate and tensioned flexible means defining foramina smaller than the apertures such as a fine woven screen. According to one embodiment, the impingement of fluid projected from fluid jets through the apertured plate onto the fibrous layer displaces the fibers laterally away from the apertures to form an apertured nonwoven fabric having apertures corresponding with the apertures of the apertured plate.

Griswold, U.S. Pat. No. 3,025,585 discloses hydroentanglement processes wherein a layer of irregularly arranged fibers is placed upon the free ends of a group of tapered projections arranged in a predetermined pattern upon a permeable backing member with interconnected fiber accumulating spaces between them. Streams of water are then directed against the layer and the fibers are deflected to produce a nonwoven fabric having apertures corresponding to the tapered projections. According to some embodiments of this invention, the tapered projections are attached to a permeable screen. According to other embodiments a single wire of a woven wire screen forms tapered projections as it passes over and under successive cross wires. Variations upon these embodiments utilizing woven screens are widely used in hydroentanglement procedures for use in production of nonwovens.

Evans, U.S. Pat. No. 3,485,706 discloses a nonwoven fabric having a pattern of apertures produced by a hydroentanglement process wherein fibers are deposited on an apertured patterning member such as a fine-wire screen or perforated plate and liquid is jetted at high pressure onto the fibrous layer to entangle the fibers in a pattern determined by the supporting member. The patent further discloses use of patterning members having apertures of random location, size and/or shape for production of non-woven fabrics which do not have regular patterns. Such patterning members are prepared by bonding grains of sand of varying sizes and shapes together so as to leave apertures between the grains. The patent further discloses treating a screen with resin to provide an arrangement of raised lines, filled holes or partially-filled holes, which may be non-repeating for a considerable distance or completely random.

Disclosures of other types of hydroentanglement processes include those of Gilmore et al., European Patent Application Publication No. 418,493 which relates to a nonwoven fabric which is produced by directing high velocity jet streams of water onto a web of fibers using a perforated drum as an aperturing member. The drum can be a cylinder having predetermined diameter and length with a repeating pattern of projections and a plurality of perforations for drainage. The projections are configured such that apertures may be formed in the web of fibers with high efficiency and the nonwoven fabric may be readily peeled off.

Phillips et al., U.S. Pat. No. 5,204,158 disclose an irregularly patterned nonwoven fabric. According to the method of producing the fabric, a fibrous web is caused to be displaced out of registry with the forming member between fluid impacts by hydroentanglement jets.

Despite the variety of hydroentanglement processes known to the art the processes are typically limited in one manner or another such as by cost, poor bonding, lack of aperture clarity, process reliability (e.g., reliable removal of web from the belt without damaging the web) and the like. Methods for production of hydroentanglement fiber webs involving metal rollers with projections as impingement substrates are limited in that the projections must be tapered thus limiting the size/spacing combinations possible. Moreover, certain complex apertured nonwoven designs may be impractical given current machining capabilities. Hydroentanglement processes making use of conventional woven screens are limited by both the patterns and surface topography of the woven filaments. Because the raised "knuckles" on woven screens are not sharply defined the definition of the resulting apertures is similarly and further degraded. In addition, the utility of conventional filament and filament-type screens is limited with respect to the patterns which can be generated. Specifically, when using woven filament screens, aperture size, distance between apertures and total open area of the apertures are dependent variables. This is because thicker filaments or wires result in increased aperture size, but also result in increased distance between individual apertures and a net decrease in aperture area in the resulting nonwoven web.

Accordingly, there remains a desire in the art for efficient methods of producing apertured nonwoven materials characterized by improved flexibility in aperture patterning including increased aperture size and area. Apertured webs characterized by the combination of large, closely-spaced, well-defined, uniformly sized (as a result of being formed on projections having solid elevated portions characterized by a periphery steeply sloped relative to the surface of the foraminous element and further characterized by a distinct upper edge as distinguished from being formed on a highly tapered projection such as formed by the "knuckles" of woven screens) apertures would prove useful as topsheets in absorbent articles in providing for rapid fluid transfer of materials such as runny bowel movements. Runny bowel movement leakage in baby diapers represents a specific problem in the baby diaper art. The problem is particularly significant in the smaller sizes. Accordingly, there exists a need in the art for improved methods of producing apertured webs by means of hydroentanglement processes.

Of interest to the present invention are the disclosures of Johnson et al., U.S. Pat. No. 4,514,345, Smurkoski et al., U.S. Pat. No. 5,098,522 and Trokhan, U.S. Pat. Nos. 4,528,239 and 5,245,025 which disclose methods for making foraminous members, the foramina of which form a preselected pattern. The Johnson patent generally discloses taking a foraminous element such as a screen and using photosensitive resins to construct about and in the foraminous element a solid, polymeric framework which delineates the preselected pattern of gross foramina. Specifically, the method comprises supplying three solid, usually planar, usually continuous materials; a foraminous element such as a woven screen; a backing film such as a thermoplastic sheet; and a mask provided with transparent and opaque regions, the opaque regions of which define the desired, preselected pattern of gross foramina. A fourth material is a liquid photosensitive resin which cures under the influence of light of a particular activating wavelength to form a relatively insoluble, relatively durable, polymeric solid. A coating of the liquid photosensitive resin is applied to the foraminous element, the mask is juxtaposed in contacting relation with the surface of the liquid photosensitive resin and the resin is exposed through the mask to light of an activating wavelength. Curing, as evidenced by solidification of the resin, is induced in those regions of the coating which are exposed to the activating light. Following exposure to light, the backing film and the mask are stripped away from the composite comprising the foraminous element and the resin. Finally, the uncured, still liquid photosensitive resin is removed from the composite by washing leaving behind the desired foraminous member the gross foramina of which define the desired preselected pattern. The Johnson patent discloses that the foraminous member produced by the process of the invention may be used in the production of an improved paper web utilizing a Fourdinier Wire paper making apparatus such that the paper making fibers in the embryonic paper web are deflected into the gross foramina of the foraminous member and the resulting paper web is a continuous web characterized by a plurality of protuberances. Of interest is the disclosure in FIG. 4 of the Johnson patent of a "negative" foraminous pattern defined by discontinuous cured resin forms. The short cellulose fibers used in papermaking react very differently than long synthetic fibers typically used in hydroentangling to produce nonwoven fabrics. Synthetic fibers such as those used in nonwoven fabrics tend to spring upwardly or away from the surface of foraminous elements following hydroentangling. Short cellulose fibers in paper production, such as those used in the Johnson patent, instead exhibit a wet collapse which means that the cellulose fibers generally do not spring upwardly as much as synthetic fibers after being formed into a web. Because synthetic fibers generally do not exhibit such a wet collapse, synthetic fibers typically do not lie as flat between projections after hydroentangling as papermaking fibers lay after settling from the slurry.

Also, whereas fibers for hydroentangling are hit with streams of fluid to form a nonwoven fabric, the cellulose fibers used for papermaking are suspended in a slurry that settles to form a web. The cellulose fibers are not hit with streams of water during paper web formation. Further, nonwoven fabrics are produced from fiber batts or mats that are laid upon the foraminous element prior to hydroentangling. In contrast, the fibers used in papermaking are in a slurry prior to contacting a foraminous element. Trokhan, U.S. Pat. No. 4,528,239, for example, discloses deposition of a fiber slurry onto a foraminous element.

SUMMARY OF THE INVENTION

The present invention relates to improved methods of producing nonwoven apertured webs using a hydroentanglement process whereby fibers are applied to a foraminous member having a patterned design and fluid streams are applied to entangle the fibers and form a hydroentangled web. Specifically, the method comprises the steps of (a) forming a foraminous member comprising gross foramina and fine foramina wherein the gross foramina define a patterned design superimposed on the fine foramina. The foraminous member is formed by means of applying a photosensitive resin onto a foraminous element comprising fine foramina, curing the photosensitive resin by photoactivation in a pattern selected such that the cured resin forms solid elevated portions on said fine foramina defining the gross foramina, and removing all uncured photosensitive resin from the foraminous member.

Preferably, the method of producing the solid elevated portions by curing the photosensitive resin by photoactivation results in solid elevated portions characterized by a periphery steeply sloped relative to the surface of the foraminous element (i.e., approaching normal to the plane of the foraminous element) and further characterized by a distinct upper edge. This distinct edge results from the sharp differentiation between the masked and unmasked photosensitive resin. Further, the mask shields resin disposed directly beneath it from radiation, resulting in elevated projections having their peripheries steeply angularly disposed to the surface of the foraminous element. The solid elevated portions may be discrete.

The method further comprises the steps of (b) providing a layer of fibers on the foraminous member; and (c) applying fluid hydroentanglement streams to the layer of fibers such that the fibers are randomly entangled in regions interconnected by fibers extending between adjacent entangled regions in a pattern determined by the pattern of the gross foramina of the foraminous member to form an apertured web.

According to preferred methods of the invention, the apertured web is produced from polyester fibers. Such fibers can be of virtually any size and preferably have a cut length between about 0.5 and about 1.0 inches and are applied at a basis weight between about 15 and about 100 grams per square yard. The fibers can also be of any cross-sectional shape, such as an ellipse or a ribbon. The widest dimension of the cross-section is typically the dimension that most determines hydroentangling characteristics.

The use of a foraminous member having gross foramina in a patterned design produced by means of curing a photo-polymerized resin provides the advantages of selection of a wide variety of custom designed aperture patterns and use of foraminous members having sharply defined edges defining the gross foramina. The ability to more precisely define the edges of the gross foramina allows for the production of apertures having extremely fine resolutions. The ability to custom design aperture patterns avoids the limitations of woven screens wherein aperture sizes, spacings and total aperture area were dependent variables. The use of foraminous members produced by curing of photosensitive resins in selected patterns allows formation of apertured webs having any combination of aperture sizes, shapes, and patterns limited only by the functional demands of the products in which the apertured webs are used. The ability to provide apertured webs having larger, and more closely spaced apertures than could be produced by means of hydroentanglement processes utilizing woven screens is of particular value in the production of absorbent articles such as diapers and other sanitary products where there exists a desire to provide an absorbent article topsheet allowing for rapid fluid transfer to absorbent layers within the article.

Preferably, the minimum distance between adjacent elevated portions (measured at the base of the elevated portions) is at least twice the diameter of the fibers being hydroentangled. The elevated portions or projections preferably have a top surface, a peripheral surface and a distinct edge at an interface of the top and peripheral surfaces. The peripheral surface is preferably steeply sloped with respect to the foraminous element. The projections may be oblong in a plane parallel to the foraminous element and have a relatively long dimension parallel to a machine direction and a relatively short dimension parallel to a cross machine direction.

The elevated portions range in height from about 0.1 mm to about 3.0 mm, preferably 0.5 to 2.5 mm and most preferably about 1 mm to about 2 mm. The pattern of elevated portions may comprise elevated portions having a plurality of shapes, a plurality of sizes or both. Additionally, the pattern formed by the elevated portions may be irregular or may form indicia, for example decorative elements, logos, or trademarks.

A further aspect of the invention is a nonwoven material comprising a web produced by fluid entanglement upon a foraminous member having projections composed of cured photosensitive resin. The nonwoven material preferably has an effective open area of at least about 12%. An effective open area of at least about 15% is more preferred, and an effective open area of at least about 20–25% is most preferred, particularly for diaper topsheets. Nonwoven materials having effective open areas of 80% or greater are contemplated.

The nonwoven material also preferably has a plurality of apertures with a size greater than 0.1 $mm^2$, more preferably with a size greater than about 0.2 $mm^2$, even more preferably with a size greater than about 0.25 $mm^2$, and most preferably with a size greater than about 1.0 $mm^2$. Aperture sizes of 7 $mm^2$ and greater are contemplated for use according to the invention.

A range for the frequency of effective apertures is about 10–1000 effective apertures per $in^2$. Preferably, the nonwoven materials have 20–100 effective apertures per $in^2$.

Apertured webs produced in accordance to the methods of the present invention may have non-regular patterns of apertures. The apertured webs may comprise meltblown fibers. Further, the apertured webs may comprise a hydrophobic surface on one side and a hydrophilic surface on the reverse side. In diapers in particular, the hydrophobic surface may be on the top surface or surface that contacts skin and the hydrophilic surface may be on the bottom surface or surface that faces away from the skin.

Numerous additional aspects and advantages of the invention will become apparent to those skilled in the art upon consideration of the following detailed description of the invention which describes presently preferred embodiments thereof.

BRIEF DESCRIPTION OF THE DRAWINGS

FIGS. 1A, 1B, 1C, 1D and 1F depict perspective views of projections having various shapes;

DETAILED DESCRIPTION OF THE INVENTION

Figure 1F:
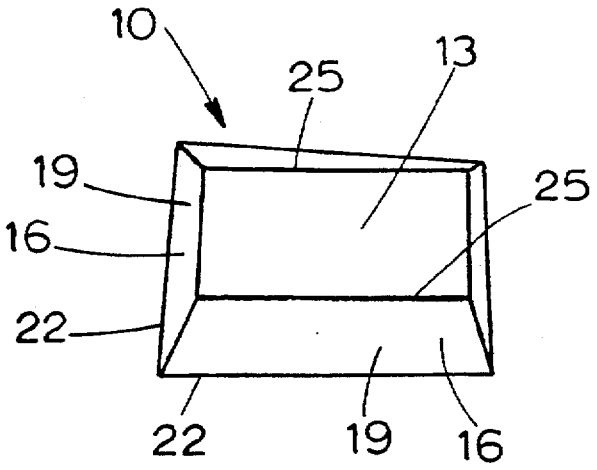

The present invention provides improved methods of forming nonwoven apertured webs by use of an improved foraminous member in a hydroentanglement process. The methods of the invention call for use of a foraminous member comprising gross and fine foramina wherein the gross foramina define a patterned design superimposed on a fine foramina. As used herein, "gross foramina" refers to the openings in the foraminous member which, because of their size and shape and distribution, form the preselected pattern with which the foraminous member is provided. Gross foramina are provided in the foraminous member through the manipulation of the photosensitive resin as described herein. It is within the gross foramina of the foraminous member that the fibers making up the nonwoven web are consolidated by the hydroentanglement process. If the foraminous member of this invention were a stencil screen, the gross foramina would define the design or pattern the screen would be used to print. "Fine foramina" is the term used herein to describe the openings present in the foraminous element about which the foraminous member is constructed. While fine foramina are usually present in some particular pattern, it is not their pattern which is referred to as the "patterned design" in the description of the foraminous member above. The "patterned design" is the pattern of the gross foramina. Typically, a fine foramen is only a fraction of the size of a gross foramen. The design defined by the gross foramina corresponds as a photographic negative to the apertures of the nonwoven fabric to be formed on the foraminous member according to the methods of the invention. Specifically, the open areas of the gross foramina are those areas on which fibers are consolidated and entangled in the course of the hydroentanglement process. The solid projections which define the gross foramina therefore correspond to the apertures of the nonwoven webs. The invention contemplates that the solid projections comprising the photopolymer may be continuous or discontinuous with the resulting effects on the pattern of apertures on the nonwoven fabric.

The foraminous member is formed by means of applying a photosensitive resin onto a foraminous element comprising fine foramina such as a screen formed of fine metal or polymeric filaments. The photosensitive resin is then cured by photoactivation in a pattern selected to produce the desired gross foramina. Specifically, a photo mask is provided which comprises transparent areas corresponding to the areas of the foraminous member where resin is to be cured and opaque areas which correspond to the gross foramina. Johnson et al., U.S. Pat. No. 4,514,345, the disclosure of which is hereby incorporated by reference discloses methods suitable for preparation of the foraminous members of the present invention which involve using a photosensitive resin to construct in and about a foraminous element a solid, polymeric framework which delineates the preselected pattern of the gross foramina of the foraminous member. Specifically, this patent teaches a method of preparing a foraminous member comprising the steps of: (a) applying a backing film to the working surface of a forming unit; (b) juxtaposing a foraminous element to the backing film so that the backing film is interposed between the foraminous element and the forming unit; (c) applying a coating of liquid photosensitive resin to the surfaces of the foraminous element; (d) controlling the thickness of the coating to a preselected value; (e) juxtaposing in contacting relationship with the coating of photosensitive resin a mask comprising both opaque and transparent regions where the opaque regions define a patterned design; (f) exposing the liquid photosensitive resin to light having an activation wavelength through the mask thereby inducing curing of the photosensitive resin in those regions which are in register with the transparent regions of the mask; and (g) removing from the foraminous element substantially all the uncured photosensitive resin.

The foraminous element is the material about which the foraminous member is constructed. Suitable foraminous elements include screens having mesh sizes of from about 6 to about 75 filaments per centimeter in either the machine direction (MD) or the cross machine direction (CD) and constructed of metal or polymeric filaments with polyester filaments being preferred. Square weave screens are suitable as are screens of other more complex weaves. Single or multiple layer designs are suitable. Filaments having either round or oval cross sections are preferred. In addition to screens, foraminous elements can be provided by woven and nonwoven fabrics, thermoplastic netting and the like.

Suitable photosensitive resins can be readily selected from the many which are commercially available. Preferred resins are polymers which cure or cross-link under the influence of radiation such as ultraviolet (UV) light. Particularly preferred liquid photosensitive resins include those disclosed in U.S. Pat. No. 4,514,345 including those in the Merigraph™ series of resins available from MacDermid Incorporated, Wilmington, Del.

In preparing the foraminous members for use with the present invention the photosensitive resin is applied to the foraminous element at a thickness selected to produce projections of a desired height on the foraminous member. The thickness of the photosensitive resin applied to the foraminous member can be controlled by conventional means such as by use of nip rolls, doctor blades and the like. The height of the projections, which define the gross foramina, above the web-facing surface of the foraminous element ("overburden") depends on the thickness of apertured web to be produced, the type of fibers used in its preparation and other factors which would be apparent to those of skill in the hydroentanglement art with such heights generally ranging from about 0.1 mm to about 3 mm and preferred thicknesses ranging from about 0.5 mm to about 2.5 mm with thicknesses of from about 1.0 mm to about 2.0 mm being most preferred. Among the considerations determining the height of the projections is the concern that the web will tear upon removal from the screen if the projections are too tall.

On the other hand, if the projections of the foraminous member are too short, the resulting apertures may lack cleanliness, that is, the apertures may have fibers crossing over them. Synthetic fibers are relatively resilient compared to cellulosic fibers. These relatively resilient synthetic fibers tend to "spring" upwardly or away from the surface of foraminous elements after the hydraulic forces are removed. Accordingly, if the sides of the projections are not steep, as the fibers spring upwardly the fibers may also spring across the tops of the projections, thereby reducing the effective aperture size or even covering the projections. Steeply sloped sides on the projections thus help provide clean apertures and help maintain maximum desired hole size. Shallowly sloped sides on the projections result in a greater variability of aperture sizes from any particular single projection size.

By producing projections that are longer in the machine direction than in the cross machine direction, removal of the webs from the screens can be facilitated and, consequently, relatively tall oblong projections may be used without tearing. Similarly, projections that do not have sharp edges in a direction perpendicular to the surface of the foraminous element, such as ellipses or circles, also facilitate removal of the webs from the screens compared to projections that are square, hexagonal or some other polygonal shape having sharp edges perpendicular to the surface of the foraminous element.

Masks useful with practice of the invention can be any suitable material provided with opaque and transparent regions so as to shade certain areas of the photosensitive resin and expose others to activating radiation. Preferred masks are produced from flexible film materials such as polyester, polyethylene or cellulosic films with gravure printed polyester films being particularly preferred. The opaque regions can be applied to the mask by means such as the Ozalid process, photographic, gravure, flexographic or rotary screen printing as are known in the art.

The liquid photosensitive resin is exposed to activating light through the mask thereby inducing curing of the resin in register with the transparent regions of the mask. Any suitable source of radiation such as are well known in the art may be used to cure the photosensitive resin. The intensity and duration of the exposure to radiation are also well within the ordinary skill in the art. Curing of the resin is evidenced by solidification of the resin in the exposed areas. After completion of such curing, the uncured resin is removed from the foraminous element by wash methods. According to one method, a precure step is carried out wherein 50 to 75% of the polymer is reacted followed by removal of the mask and barrier. Next, the pre-foraminous member is vacuumed to remove uncured liquid resin and a wash step is carried out to remove the remaining uncured liquid resin. Finally, a post cure step is carried out to complete polymerization of the initial solidified resin.

The patterned design defined by the gross foramina on the foraminous member corresponds to the fiber containing areas on the nonwoven fabric and is determined by the design of opaque areas on the mask. Conversely, the apertures of the nonwoven fabric correspond to the raised areas of cured resin on the foraminous member. Because of the great flexibility of the photo-curing methods utilized by the invention, apertures of virtually any size, shape, height, alignment and pattern can be created in nonwoven fabrics according to the end uses of those fabrics.

The methods of the present invention are particularly useful for the production of apertured webs useful in absorbent articles such as diapers. In particular, the methods of the invention may be used to produce diaper topsheets characterized by high levels of effective open areas. High levels of effective open areas are especially important for fabrics used in topsheets of absorbent articles, because the ability of a fabric to pass viscous fluids is partially determined by effective open area. In particular, elevated levels of effective open areas are useful for rapid transmission of fluid associated with runny bowel movements.

Effective open area refers to the ratio of the area of apertures in a fabric which are highly effective to transmit fluid to the total area of the fabric. Effective open area is defined as the ratio of the number of pixels having a gray level from 0 through 18 as defined below to the total number of pixels for the image. Effective apertures are defined as those apertures having a gray level of 18 or less on a standard gray level scale of 0–255, under the image acquisition parameters described in U.S. Pat. No. 5,342,338 to Roe, the disclosure of which is hereby incorporated by reference. The portion of that disclosure describing effective apertures and effective open areas is included below.

The effective aperture size and percentage open area are determined by the following procedure using the image analysis system described below. The procedure has three principal steps: image acquisition, i.e., obtaining representative images of areas on the surface of the first topsheet; image measurement, i.e., measuring the percentage open area of an image and of individual apertures and their perimeters; and data analysis, i.e., exporting the percentage open area, individual aperture area, and perimeter measurements to a spreadsheet where frequency distributions, sum of area distributions, and hydraulic radius computations are made.

An image analysis system having a frame grabber board, microscope, camera and image analysis software is utilized. A model DT2855 frame grabber board available from Data Translation of Marlboro, Mass. is provided. A VH5900 monitor microscope, a video camera, having a VH50 lens with a contact type illumination head available from the Keyence Company of Fair Lawn, N.J. are also provided and used to acquire an image to be saved to computer file. The Keyence microscope acquires the image and the frame grabber board converts the analog signal of this image into computer readable digital format. The image is saved to computer file and measured using suitable software such as the Optimas Image Analysis software, version 3.1, available from the BioScan Company of Edmonds, Wash. In order to use the Optimas Image Analysis software, the computer should have Windows software, version 3.0 or later, available from the Microsoft Corporation of Redmond, Wash. and also have a CPU at least equivalent to the Intel 80386, however, any suitable desk top PC (e.g., Apple MacIntosh) with the appropriate image analysis software may be used. A 486 DX33 type PC has been found to be particularly suitable. Images being saved to and recalled from file were displayed on a Sony Trinitron™ monitor model PVM-1343MO with a final display magnification of about 50X.

The image acquisition step, noted above requires 10 different regions from a representative first topsheet sample of a particular type of diaper or from sample material to be tested. Each region is rectangular, measuring about 5.8 millimeters by 4.2 millimeters. The sample is placed on a black mat board to increase the contrast between the apertures and the portion of the sample which defines the apertures. The means gray level and standard deviation of the black mat board were 16 and 4, respectively.

Images are acquired with room lights off using the Keyence monitor microscope mounted on a copystand directly above the sample. The Keyence light source illuminating the sample is adjusted and monitored with the Optimas software to measure the mean gray level and standard deviation of a 0.3 density wedge on a Kodak Gray Scale available from Eastman Kodak Company of Rochester, N.Y. The control of Keyence light source is adjusted so that the mean gray level of the illuminated wedge is 111+/−1 and the standard deviation is 10+/−1. All images were acquired during a single time period, and the Keyence light source is monitored by measuring the mean gray level and standard deviation of the wedge throughout the image acquisition process.

In measuring an individual aperture, only the effective aperture size is of interest. Measuring the effective aperture size quantifies the aperture size intended to contribute to the porosity of the first topsheet, and account for contributions of fibers and fiber bundles which traverse an area intended to be an aperture. An effective aperture is any hole through the first topsheet having a gray level less than or equal to 18 using image acquisition parameters as described herein. Thus, an intended aperture may be divided into plural effective apertures by traverse fibers.

The image analysis software is calibrated in millimeters by a ruler image acquired from the sample images. A 3 by 3 pixel averaging filter found in the Optimas 3.1 Image menu is applied to each saved image to reduce noise. The apertures are detected in the gray level range of 0 through 18. An aperture which is not fully contained within the 5.8 by +/−2 viewing area is not considered in the individual area and perimeter measurements. Therefore area and perimeter averages and distributions are not affected by apertures which are not wholly contained within the field of view.

However, individual apertures which could not be fully viewed in the image are included in the percentage open area calculation. This difference occurs because the percent open area is simply the image of pixel ratios from 0 through 18 to the total number of pixels in the image. Areas having a gray level 19 or greater were not counted in the open area calculation.

The percentage open area for the average of 10 images for each first topsheet is measured using the Optimas Image Analysis software. The percentage open area, as discussed above, is defined as the ratio of the number of pixels having a gray level from 0 through 18 to the total number of pixels for the image. The percentage open area is measured for each image representing one particular region from a first topsheet sample. The percentage open area from each of the 10 individual images is then averaged to yield a percentage open area for the entire sample.

The data analysis is conducted by an Excel spreadsheet, also available from the Microsoft Corporation of Redmond, Wash. The Excel spreadsheet organized the percentage open area, aperture area, and aperture perimeter measurements obtained from the Optimas software. Sample averages and standard deviations, size and frequency distributions of individual aperture areas and hydraulic radius computations (area divided by perimeter) for individual apertures are obtained using the spreadsheet.

Distributions of individual aperture area are also computed using the Excel spreadsheet. The apertures are sorted into bins of certain size ranges. The number of aperture areas falling into certain size ranges of interest is determined as well as the sum of the areas within each range. The ranges are set in increments of 0.05 square millimeters. These areas are expressed as a percentage of the total open area of the sample. The frequency and sum of the area distributions are obtained by combining individual aperture measurements from all 10 images for each sample.

The hydraulic radius for individual apertures is also computed by the Excel spreadsheet. The hydraulic radius is considered to be the individual aperture area divided by respective perimeter as taken from the Optimas software.

Once the hydraulic radii of the apertures is computed, a distribution for hydraulic radii within certain ranges may be easily determined. Additionally, a distribution for the hydraulic radii of apertures within certain size ranges may be easily determined.

The nonwoven materials preferably have a plurality of apertures with a size greater than 0.1 $mm^2$. Apertures greater than 0.2 $mm^2$ are more preferred, particularly for nonwoven materials to be used as topsheets in absorbent articles. Apertures greater than 0.25 $mm^2$ are even more preferred, and apertures greater than 1.0 $mm^2$ are most preferred, particularly for fabrics used as diaper topsheets. Apertures of 7 $mm^2$ and greater are contemplated for use according to the invention.

Nonwoven materials having effective open areas of at least about 12% are preferred. Nonwoven materials having effective open areas of at least about 15% are more preferred, especially in materials used for diaper topsheets.

An effective open area of at least about 20–25% is most preferred, particularly for materials used as diaper topsheets. Nonwoven materials having effective open areas of 80% and greater are also contemplated by the invention.

The frequency of effective apertures is preferably about 10–1000 effective apertures per $in^2$ and most preferably about 20–100 effective apertures per $in^2$.

Raised areas having different heights and/or wall slopes can be formed and the porosity of the underlying foraminous member can be varied. For example, where a nonwoven material is to be used as a topsheet in an absorbent sanitary product such as a diaper, the apertured web can be provided with larger and more numerous apertures at some locations and fewer and smaller at others according to the particular requirements of that product. For example, there is a need for larger and more numerous apertures in topsheets used in diapers for newborn babies in order to more rapidly absorb runny bowel movements. The requirements of different products or even of various portions of single products can thus be accommodated by the method of the present invention. Nevertheless, apertures should not be created which detract from the structural integrity of the nonwoven web.

The projections may be a variety of shapes. A projection 10 in FIG. 1A has a relatively flat top surface 13, a periphery 16 including sides 19, and a bottom portion 22. A distinct edge 25 is defined at the interface of the flat top surface 13 and the sides 19. The shape of the flat top surface 13 and of the periphery 16 may take many forms, such as the diamond, square, hexagon, oval, and circle shown in FIGS. 1A–1E, respectively.

Figure 2:
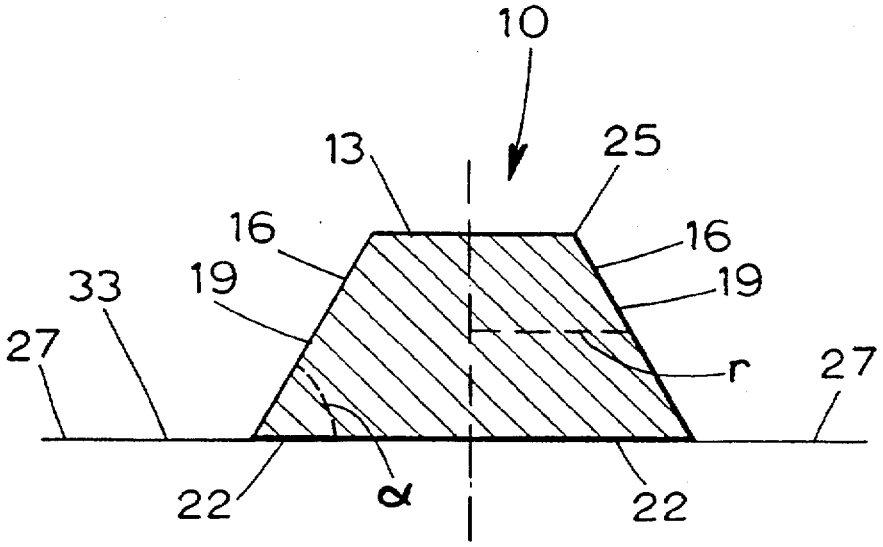
FIG. 2 depicts a sectional view of a projection having a periphery at an oblique angle with respect to the surface of a foraminous element.
Figure 3:
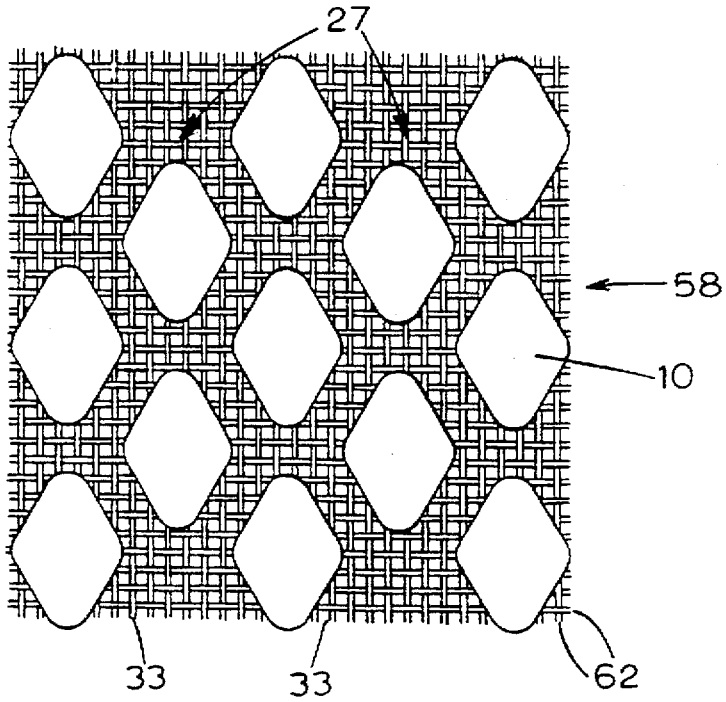
FIG. 3 depicts a foraminous member used according to the methods of the invention.

The distinct edge 25 results from the sharp differentiation between the masked and unmasked photosensitive resin. Resin directly below the mask is shielded from radiation, resulting in projections having the periphery 16 steeply sloped with respect to a surface 27 (FIGS. 2 and 3) of a foraminous element 33 (FIGS. 2 and 3). The distinctness of the edges 25 between the top surface 13 and the periphery 16 is one factor in determining the cleanliness of the apertures in the web formed by hydroentangling. If the edge 25 is not distinct, fibers will spring upwardly or away from the surface 27 of the foraminous element 33 after the fluid streams from the hydroentangling are stopped. This may result in fibers that do not separate the target distance from the longitudinal axis of the projections 10. As shown in FIG. 2, r is the distance from the longitudinal axis of the projection 10 to the periphery 16. The less that r decreases in a direction from the surface 27 of the foraminous element 33 to the flat top surface 13 of the projection 10, the more the size of a resulting aperture is maintained after the fluid streams from hydroentangling are stopped.

During hydroentanglement, the fibers advance downwardly toward the surface 27 of the foraminous element 33 between the projections 10. In the case of projections 10 having periphery 16 steeply sloped relative to the surface 27 of the foraminous element 33 (e.g., the embodiments of FIGS. 1A–1E) the fibers will advance farther down toward the surface 27 of the foraminous element 33 and will pack more tightly, because with steeply sloped periphery 16 there is little or no decrease in the space between the projections 10 from the top surfaces 13 of the projections 10 to the bottom portions 22.

The flat top surface 13 and the edges 25 help define clean apertures (i.e., apertures with few or no fibers crossing them) having intended size. Periphery 16 having a steep slope maintains the aperture size after fluid pressure has been removed. An angle α, shown in FIG. 2, is defined as the angle between the periphery 16 (or the sides 19 in embodiments having sides 19) and the surface 27 of the foraminous element 33. The angle α is preferably between about 60 and about 90 degrees, more preferably between about 70 and about 90 degrees, and most preferably between about 75 and about 85 degrees. Thus, the projection 10 need not have the substantially perpendicular periphery 16 depicted in FIGS. 1A–1E, but instead may have the periphery 16 oriented obliquely with respect to the surface 27 of the foraminous element 33, as shown in FIGS. 1F and 2.

In order to produce projections having different values of angle α, the collimation level is changed so that the angle which radiation contacts the unmasked resin is modified accordingly. For example, thin collimators absorb relatively small amounts of off-axis radiation, producing projections having relatively lower values of α, whereas thick collimators absorb relatively large amounts of off-axis radiation, producing projections having relatively higher values of α.

Using projections made from photosensitive resin, the size of the apertures produced is not a function of the mesh of the screen or a function of the thickness of the filaments in the screen making up the fine foraminous member. By decoupling the aperture size from those variables, apertures of many different sizes can be produced using screens having many different mesh sizes and comprising fibers of various sizes. In other words, the screen can be optimized separately from the pattern of apertures.

Patterns can be flexibly designed and easily produced using foraminous members of the present invention to produce nonwoven fabrics. FIG. 3 shows a foraminous member 58 having a symmetrical patterned design comprising projections 10 of a single shape and size. Unsymmetrical patterns and patterns having a variety of projection sizes can also be produced.

By producing nonwoven fabrics on foraminous elements 33 having patterned designs of differently sized projections 10, nonwoven fabrics having differently sized apertures can be produced. Apertures of large size can be located where desired, and smaller apertures can be located where desired in the fabric. Also, the closeness of the projections 10 to one another can be varied, resulting in nonwoven fabrics having apertures spaced from one another as desired, including irregular distribution. This is advantageous for absorbent articles such as diapers because large, closely spaced apertures can be placed in the bowel movement acquisition zone. The patterns can additionally or alternatively be decorative. For example, trademarks and other aesthetic designs can be incorporated into the fabrics.

The minimum spacing of the projections 10 generally must be at least two to three times the largest dimension of the fiber cross-section and is measured at the bases of the projections 10 on the foraminous element 33. Also, as previously mentioned, the projections 10 can be oblong in the machine direction to facilitate removal of the web without tearing the web. Thus, flexibility is required in the creation of projections 10 so that the length in the machine direction and the height of the projections 10 may be varied.

The foraminous member produced according to the methods described above may then be used in the production of apertured webs by means of a hydroentanglement process comprising the steps of providing a layer of fibers on the foraminous member and applying fluid streams to the layer of fibers such that the fibers are randomly entangled in regions interconnected by fibers extending between adjacent entangled regions in a pattern determined by the pattern of the gross foramina of the foraminous member to form an apertured web.

In practicing the methods of the invention, a layer of fibers such as a nonwoven batt or other initial fibrous layer is formed on the foraminous member and is subjected to a hydroentanglement process such as are well known in the art. In this regard, the disclosures of Griswold, U.S. Pat. No. 3,025,585 and Evans, U.S. Pat. No. 3,485,706 are incorporated herein by reference. The initial layer may consist of any web, mat, or batt of loose fibers, disposed in random relationship with one another or in any degree of alignment, such as might be produced by carding and the like. The fibers can be any natural, cellulosic, and/or wholly synthetic material including but not limited to meltblown fibers, spunlaid fibers with continuous filaments, carded staple length fibers, and laminates and mixtures of the above. According to preferred methods of the invention, the apertured web is produced from polyester fibers. The fibers can be of virtually any size and preferably have a cut length between about 0.04 and about 2.0 inches and are applied at a basis weight between about 15 and about 100 grams per square yard. Wet laid webs preferably comprise fibers about 0.04 to 0.5 inches long. Carded webs preferably comprise fibers about 1–2 inches long. Air laid webs preferably comprise fibers 0.5–1.0 inches long.

The fibers can also be of any cross-sectional shape, such as an ellipse or a ribbon. The widest dimension of the cross-section is typically the dimension that most determines hydroentangling characteristics. The initial layer may be made by any desired technique, such as by carding, random laydown, air or slurry deposition and the like. It may consist of blends of fibers of different types and/or sizes. In addition, the initial layer may be an assembly of loose fiber webs, such as for example cross-lapped carded webs. Predominantly carded nonwovens use fibers having a staple length of about 0.04–2 inches. Dexter Corporation of Hartford Connecticut has a Hydrospun® technology that combines wet laying of relatively short (<5 mm) fibers with hydroentangling to produce soft, strong, absorbent nonwovens particularly suitable for wipes. Another example of an initial layer is a coform of wood pulp fibers entrained in a stream of meltblown synthetic fibers.

For more effective feminine hygiene formed film topsheets, hydrophobic upper topsheet surfaces are preferred and hydrophilic lower (apertured) surfaces are preferred. The fluid moves from the top or hydrophobic surface to the bottom or hydrophilic surface. Nonwoven topsheets having the hydrophobic and hydrophilic regions can be produced by using the method of the present invention to act upon two layers of fibers: an upper hydrophobic polypropylene layer and a lower hydrophilic (e.g., PET, nylon) layer.

Handling urine is also a use for fabrics made in accordance with the present invention. For handling urine, very open topsheets permit the use of more hydrophobic materials such as polypropylene, silicone treated filaments, and fluorocarbon treated filaments such as PTFE. Advantages of hydrophobic materials include a cleaner appearance than many other materials and a dryer feel than many other materials.

When very low denier or capillary channel fibers are used, especially those being hydrophilic or some fraction cellulosic, then the resulting fabic is a very good surface cleaner. Such a fabric is useful in mops and the like to remove water films from surfaces without leaving "streaks". The texture provided by the apertures is an excellent skin cleaning surface because it has void volume that can be filled with dirt. The fabric can also be an excellent baby wipe for that reason.

In order to adequately interentangle the fibers, the fluid streams impinging upon the fibrous layer can be formed at high pressure and present a high energy flux. The design of hydroentanglement jets and the selection of operating parameters and conditions for their use is well within the ordinary skill of those in the art.

In operating the process, water or another suitable liquid or fluid is forced under high pressure through small diameter orifices so as to emerge continuously or intermittently in the form of fine, essentially columnar, high-energy flux streams. The web or other fibrous layer is placed on the foraminous member and the assembly is moved, layer side up, into the path of the high-energy-flux streams. Either the web, or the streams, or both are moved to traverse the web. The high-energy flux streams impinge upon and physically cause the individual fibers to move away from the projections defining the gross foramina and into the depressions corresponding to the gross foramina on the foraminous member. As the impingement continues the fibers of the web are simultaneously realigned, entangled, and locked into place in a pattern corresponding to the pattern of the gross foramina. The resulting structure comprises fibers arranged in an ordered geometric pattern of intersecting bundles locked together at their intersections solely by fiber interaction.

The shape and length of the fibers and the steepness of the slope of the periphery 16 of the projections 10 affect the final aperture size, because synthetic fibers tend to rise or spring upwardly away from the foraminous element 33 after the high energy flux streams stop. Because the periphery 16 of the projection 10 is steeply sloped relative to the surface 27 of the foraminous element 33, as shown in FIGS. 1A–1E, the fibers will be constrained by the periphery 16 of the projection 10 to only rise vertically, substantially perpendicular to the surface 27. In that case, the size of the apertures will remain unchanged by the rise of the fibers following hydroentangling.

In contrast, hydroentangling upon foraminous elements 33 having projections 10 at shallow slopes with respect to the surface 27 allows fibers to rise inwardly along the periphery 16 of the projections 10, as well as upwardly, resulting in apertures smaller than the bases of the projections. For example, the projection 10 shown in FIG. 2 may be susceptible to fibers rising inwardly along the periphery 16, after hydraulic pressure is stopped, because of the relatively shallow slope of the periphery 16 (i.e., because the value of r drops rapidly from the bottom portion 22 to the top surface 13 of the projection 10).

The apertured webs of the present invention may be dried while still on the foraminous members but are preferably dried after removal from it. The apertured webs may be subjected to dyeing, printing, heat treatment, or to other types of conventional fabric processing including treatment with resins, binders, sizes, finishes, and the like, surface-coated and/or pressed, embossed, or laminated with other materials.

The invention will be better appreciated by consideration of the examples of specific embodiments thereof presented herein. These examples are illustrative of the invention but are not to be considered to be limitative thereof.

Example 1 describes forming a foraminous member according to the invention.

Example 2 describes use of the foraminous member produced by the method of example 1 to produce an apertured web according to the invention.

EXAMPLE 1

According to this example, a foraminous member comprising gross foramina and fine foramina wherein the gross foramina is produced according to the methods of Johnson et al., U.S. Pat. No. 4,514,345, Smurkoski et al., U.S. Pat. No. 5,098,522 and Trokhan, U.S. Pat. No. 4,528,239 the disclosures of which are hereby incorporated by reference. Specifically a photosensitive resin is applied to the foraminous element (33) of FIG. 3 comprising a woven matrix of filaments (62) defining fine foramina and was covered with a photo mask having transparent portions defining rounded vertex diamond-shaped projections. Activating radiation is transmitted through the mask to cure the photosensitive resin on the foraminous element (33) such that the cured resin forms elevated portions or projections (10) on said fine foramina defining gross foramina. The uncured photosensitive resin is then removed from the foraminous element (33) to produce a foraminous member (58) comprising gross foramina defined by the elevated portions (10) and fine foramina wherein the gross foramina define a patterned design superimposed on the fine foramina.

EXAMPLE 2

In this example, a foraminous member (58) comprising gross foramina and fine foramina which is produced according to the method of example 1 is used to produce an apertured web. The foraminous member (58) is formed on a foraminous element which is a woven matrix (33) comprising 50 filaments per inch in the machine direction and 50 filaments per inch in the cross machine direction woven in a square weave design. The filaments (62) in each direction are 0.006 inches in diameter and made of polyester. The thickness of the foraminous element (33) is about 0.012 inches. The gross foramina are created by the intermittent positioning of the elevated photopolymer protuberances (10) on the foraminous element (33). The elevated portions (10) are in the shape of rounded vertex diamonds occurring at a frequency of 37 discrete elevated portions per square inch. The elevated portions (10) occur at a machine direction pitch of about 0.22 inches and a cross machine direction pitch of about 0.12 inches. Each protuberance (10) extends about 0.025 inches from the web-side surface of the foraminous element (33). Each elevated portion (10) has a dimension of about 0.1725 inches in the machine direction and about 0.1214 inches in the cross machine direction. The radius of curvature at each vertex of protuberance is about 0.025 inches. The elevated portions cover about 50% of the total area of the foraminous member (58).

Figure 4:
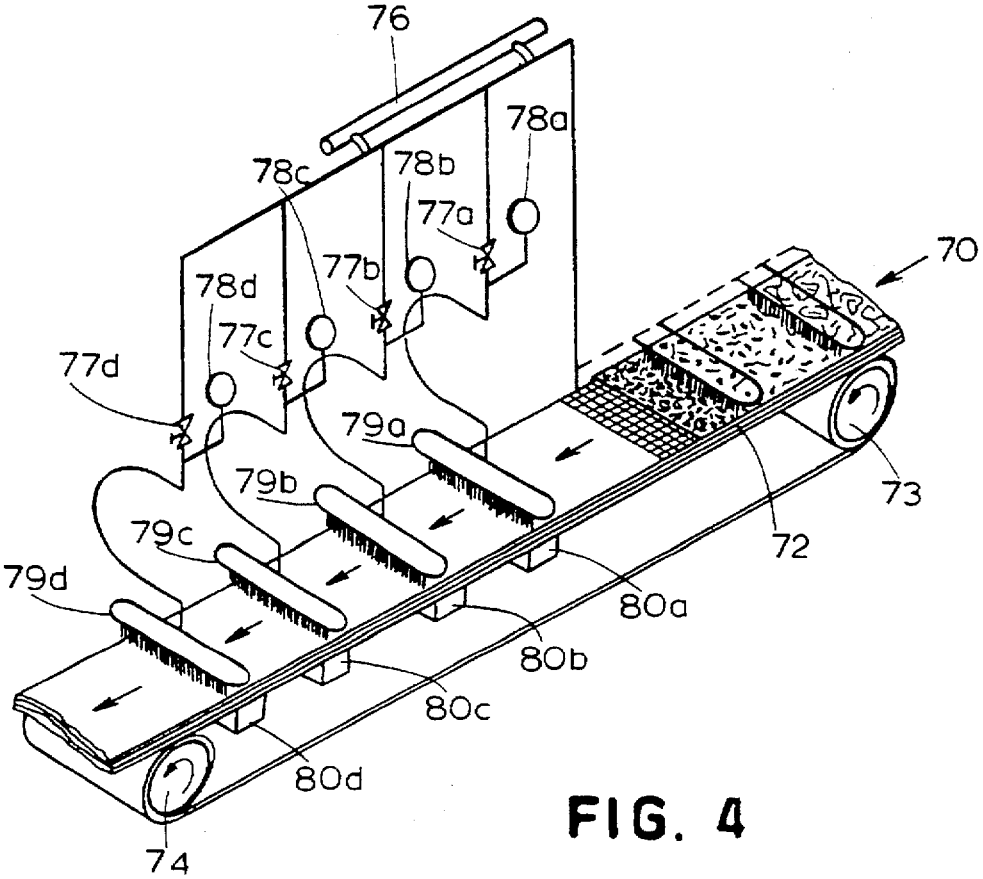
FIG. 4 is a simplified schematic depicting an apparatus for producing the apertured webs of the invention.

According to the method depicted in FIG. 4 an unbonded fibrous web (70) is provided to and supported by a forming belt (72) comprising the foraminous member (58) produced according to the method of Example 1. The fibrous web can be composed of polyester staple fibers characterized by the following parameters: denier, from 1.0 to 3.0 dpf, preferably 2.0 dpf; cut length, from 0.5 to 1.0 inch, preferably about 0.75 inch; basis weight from 15 g/square yard to 100 g/square yard, preferably about 50 g/square yard. The forming belt (72) is supported and driven by rolls (73) and (74). Meltblown fibers or other fibers are also suitable.

High pressure water is supplied to the process from a piping line (76) which is supplied from pumps and a reservoir (not shown). The water is directed into several supply lines which are regulated by valves (**77*a*–77*d*), and pressure controllers (78*a*–78*d*). The water is then supplied to a series of manifolds, (79*a*–79*d***), each of which contain rows of high pressure jets. Given the control scheme presented each manifold can maintain its own pressure according to the desired characteristics of the finished web.

Each manifold has a cooperating vacuum box (**80*a*–80*d***) which is located below its manifold and in close proximity to the forming belt. Each of these vacuum boxes has a slot opening positioned against the underside of the forming belt through which air is drawn by pumps and piping to de-water the fibrous web. Each water supply line, valve controller, manifold and vacuum box constitutes a forming zone. Typical process conditions for the forming zones range from 100 to 3,000 psi, preferably about 1000 psi for water pressure, and 5 to 30 inches of water, preferably about 20 inches of water for the vacuum level.

Figure 5:
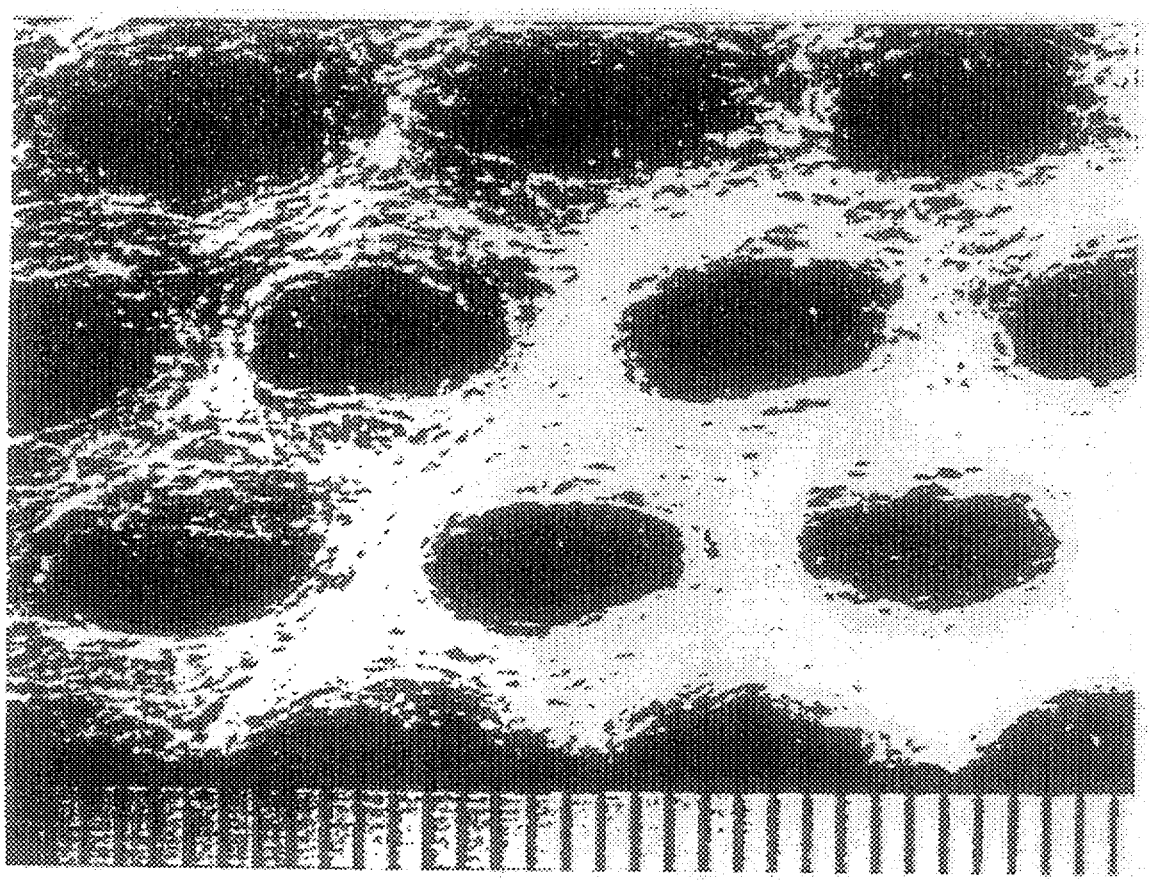
FIG. 5 is a photomacrograph of an apertured web of the invention.

As the water passes through the fibrous web and forming belt into the vacuum boxes the fibers are pushed away from the projections (solid knuckles) to the open areas of the forming belt thus forming apertures or open areas in the fibrous web. This action also serves to entangle the fibers which imparts a degree of structural integrity to the web. The resulting web is essentially a mirror or reverse image of the forming belt. The web may then be used as a topsheet in the manufacture of absorbent articles such as diapers, sanitary napkins and the like. FIG. 5 is a photomacrograph depicting an apertured web produced according to the invention wherein the fibers making up the web and the apertures defined by those fibers are clearly visible. The scale marks at the bottom of the photograph are in 0.5 mm increments.

Numerous modifications and variations in the practice of the invention are expected to occur to those skilled in the art upon consideration of the foregoing description of the presently preferred embodiments thereof For example, as an alternative process to that described in Example 2, the forming section may be consolidated into a circular design where the forming belt is essentially a cylindrical screen. High pressure manifolds are positioned in a radial array around the rotating screen which houses a vacuum chamber. In this process scheme, multiple forming stages are common to achieve a particular fabric design. Consequently, the only limitations which should be placed upon the scope of the present invention are those which appear in the appended claims.

What is claimed is:

1. A method of forming an apertured web comprising the steps of:

(a) forming a foraminous member comprising gross foramina and fine foramina wherein the gross foramina define a patterned design superimposed on said fine foramina by means of applying a photosensitive resin onto a foraminous element comprising fine foramina, curing said photosensitive resin by photoactivation in a pattern selected such that said cured resin forms elevated portions on said fine foramina defining said gross foramina, and removing all uncured photosensitive resin from said foraminous member;

(b) providing a layer of fibers on said foraminous member; and (c) applying fluid streams to said layer of fibers such that the fibers are randomly entangled in regions interconnected by fibers extending between adjacent entangled regions in a pattern determined by the pattern of the gross foramina of the foraminous member to form an apertured web;

wherein said elevated portions are discrete are characterized by a periphery steeply sloped and oblique relative to a surface of the foraminous element and by a distinct upper edge.

2. The method of claim 1 wherein the slope of the periphery relative to the surface of the foraminous element is between about 60 degrees and about 90 degrees.

3. The method of claim 2 wherein the slope of the periphery relative to the surface of the foraminous element is between about 75 degrees and about 85 degrees.

* * * * *